US007422492B2

(12) United States Patent
Zugel et al.

(10) Patent No.: US 7,422,492 B2
(45) Date of Patent: Sep. 9, 2008

(54) ANGLED ELECTRIC PLUG-IN CONNECTOR COMPRISING A FIRST ANGLED LIMB AND A SECOND ANGLED LIMB

(75) Inventors: Fritz Zugel, Waldkirch (DE); Mario Bartholoma, Winden (DE); Volker Gotz, Kenzingen (DE); Philipp Gerber, Gutach (DE)

(73) Assignee: Anton Hummel Verwaltungs GmbH, Waldkirch (DE)

( * ) Notice: Subject to any disclaimer, the term of this patent is extended or adjusted under 35 U.S.C. 154(b) by 17 days.

(21) Appl. No.: 11/573,598

(22) PCT Filed: Jun. 28, 2005

(86) PCT No.: PCT/EP2005/006935

§ 371 (c)(1),
(2), (4) Date: Feb. 12, 2007

(87) PCT Pub. No.: WO2006/018060

PCT Pub. Date: Feb. 23, 2006

(65) Prior Publication Data

US 2008/0064268 A1 Mar. 13, 2008

(30) Foreign Application Priority Data

Aug. 18, 2004 (DE) ..... 20 2004 012 953

(51) Int. Cl.
*H01R 13/11* (2006.01)

(52) U.S. Cl. ..... 439/855; 439/881; 439/954; 439/799

(58) Field of Classification Search ..... 439/789, 439/799, 808, 854, 855, 881, 954
See application file for complete search history.

(56) References Cited

U.S. PATENT DOCUMENTS 3,107,967 A * 10/1963 Sewell ..... 439/786

(Continued)

FOREIGN PATENT DOCUMENTS

DE 3403772 8/1985

(Continued)

*Primary Examiner*—James Harvey
(74) *Attorney, Agent, or Firm*—Volpe and Koenig, P.C.

(57) ABSTRACT

An angled plug-in connector (1) is provided having an insulating body that is located in a first angled limb (2) and that contains electric contacts. The conductor or conductors that extend from the insulating body extend through a second angled limb (3). The opposing end faces (2*a*, 3*a*) of the angled limbs (2,3) that lie in the angled region are oblique, generally forming a mitre and are interconnected by an articulation or in a detachable manner. At least one of the two angled limbs is provided with a recess or annular groove (10), which extends over the greater part of a circumference thereof, is open to an exterior over at least a part of its length, and in which a fitted spring-loaded ring (11) can be placed. The ring (11) is open or includes a gap (12) and has two end sections (13). At least one of the end sections projects beyond the recess or annular groove (10), extending from the angled limb when in the working position and engages in a retaining element (9) on the other angled limb, when in the locked or working position of the plug-in connector.

26 Claims, 3 Drawing Sheets

U.S. PATENT DOCUMENTS

| | | | | |
|---|---|---|---|---|
| 3,323,097 | A * | 5/1967 | Tordoff | 439/370 |
| 4,550,957 | A * | 11/1985 | Keane | 439/13 |
| 6,283,510 | B1 * | 9/2001 | Bartholoma et al. | 285/184 |
| 6,593,531 | B2 * | 7/2003 | Hulsmann et al. | 174/66 |
| 6,887,093 | B1 * | 5/2005 | Stenberg et al. | 439/372 |
| 2007/0249205 | A1 * | 10/2007 | Zugel et al. | 439/224 |
| 2008/0064268 | A1 * | 3/2008 | Zugel et al. | 439/695 |

FOREIGN PATENT DOCUMENTS

| | | |
|---|---|---|
| DE | 3709963 | 5/1988 |
| DE | 8914027.3 | 2/1990 |
| DE | 4201764 | 8/1992 |
| DE | 20003976 | 6/2000 |
| EP | 0411239 | 2/1990 |

* cited by examiner

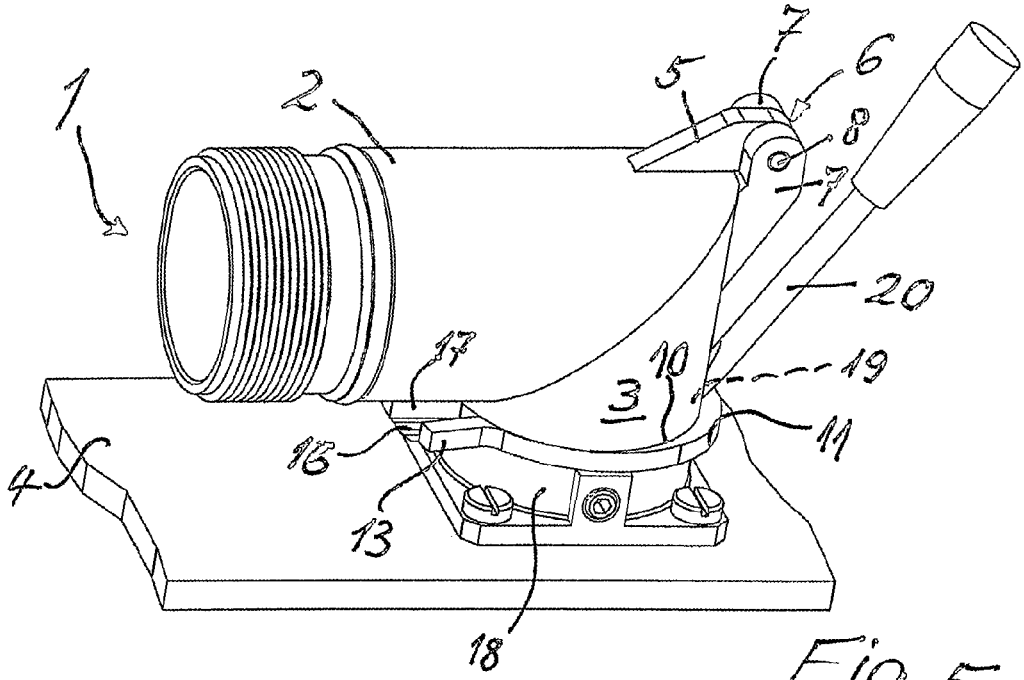
Fig. 5
Fig.6
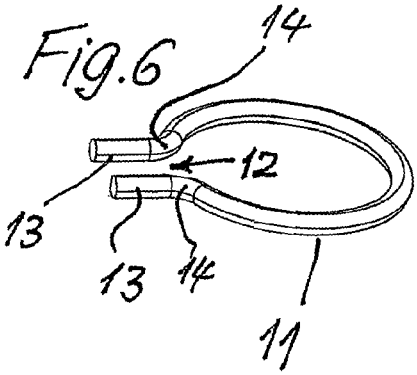
Fig.7
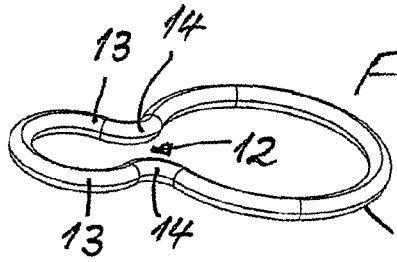
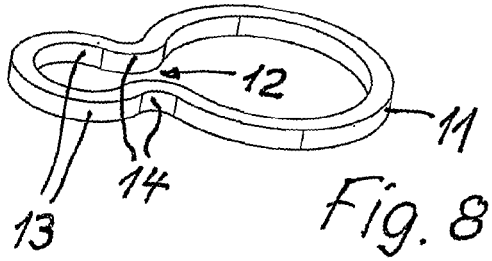
Fig. 8

ANGLED ELECTRIC PLUG-IN CONNECTOR COMPRISING A FIRST ANGLED LIMB AND A SECOND ANGLED LIMB

BACKGROUND

The invention relates to an angled electric plug-in connector, in particular, comprising an insulating body that contains electric contacts and that is located in a first angled limb of the plug-in connector in the working position. The conductor or conductors projecting out of the insulating body and the electric contacts run through a second angled limb to a load or to a power source. The two opposing end faces of said angled limbs that lie in the angled region are oblique and essentially form a miter joint and—in particular in the area of an outer meridian line—are interconnected in an articulated or detachable way at least in the working position. In addition, there is a retaining element fixing the working position of the two angled limbs.

Such an angled plug-in connector is known from DE 200 03 976.8 U1 and has proven to be effective. For mutual fixing of the two angled limbs in the working position, flanges or flange parts, which can be fixed to each other and to a housing wall or the like by a screw passing through them in common, are provided on both angled limbs. Therefore, the two angled limbs are fixed to each other, but a great effort is necessary for this mutual fixing of the working position when closing the two angled limbs, which can pivot relative to each other. Above all, the screwing procedure is time intensive especially when several screws have to be set.

Indeed, from DE 34 03 772 C2 and from DE 37 09 963 C1 an angled conductor lead-in, which has no insulating bodies with electric contacts, is known, in which the two angled limbs can be latched to each other, with the latching devices having to be attached to the angled limbs themselves. The mutual connection is no longer possible if, for example, one of the latches is damaged or breaks off due to material fatigue or overloading.

SUMMARY

Therefore, there is the objective of creating an angled plug-in connector of the type named above, in which the assembly and especially reaching the working position demands less time and in which the risk that the mutual connection of the angled limbs will become unusable is reduced.

For meeting this objective, the angled plug-in connector defined above is characterized in that on at least one of the two angled limbs there is a recess or annular groove, which runs over the greater portion of its periphery, which is open to the outside over a portion of its profile, and in which a fitting spring ring can be inserted or latched; this spring ring is open or discontinuous in its profile and at the opening or gap has two end parts, of which at least one projects opposite the recess or annular groove in the working position and extends from the angled limb and engages the retaining element on the other angled limb in the closed or working position of the plug-in connector, so that it is connected thereto or engages therein.

In this way, the angled plug-in connector can be locked, and no time-intensive screw-in processes have to be performed in order to fix the two angled limbs in their working position. Instead, there is a spring ring, which can be locked and which can lock on one angled limb due to its form running over more than half of the periphery of this angled limb and then the retaining element on the other angled limb engages with at least one of the two end parts, so that both angled limbs are connected to each other, in particular, detachably. Thus, the risk that latching parts, which are connected integrally to the angled limbs themselves and which are used for mutual connection, will become damaged or even break off and therefore weaken or make impossible the mutual connection is reduced or eliminated.

The mutual connection of the first and second angled limbs to each other is especially good when the two especially symmetrically shaped end parts of the spring ring attach to the retaining element in the working position on the other angled limb or engage therein or are connected thereto. The two end parts, which emerge from the gap or opening of the ring profile, can thus be pulled in for connecting to the other angled limb, which improves the mutual connection. Because the spring ring is open, that is, it has a discontinuous profile, it can also be easily bent somewhat against its restoring force for latching on the angled limb carrying it, in order to then spring back into the working position and to contact against or in the recess or annular groove over more than half the periphery of this angled limb.

So that the spring ring can run over more than 180° along the periphery of an angled limb having arbitrary cross-sectional contours and can wrap around this limb in a locking way, in the working position the two end parts arranged on both sides of the gap in the spring ring can have a smaller spacing than corresponds to the greatest cross section of the angled limb or the diameter of the spring ring and the two end parts can also be bent outwards opposite the spring ring profile and, in particular, can be arranged in the plane spanned by the spring ring. The spring ring can thus have the approximate shape of a "C" but with the two free ends carrying end parts that project outwards and that engage the second angled limb and the retaining element present there in the closed position of the plug-in connector.

The end parts of the spring ring projecting opposite the annular groove of one angled limb and opposite the spring ring in the direction towards the other angled limb can have a spacing, in which a conical spreader element of the retaining element can be inserted while widening at least these end parts or their spacing. This spreader element is arranged on the other angled limb and there is undercutting under the conical spreader element for the end parts, wherein the conical spreader element is somewhat mushroom-shaped or has an approximately mushroom-shaped longitudinal section and overlaps the spring ring end parts in the working position with the spreader element.

In this way, a quick-connect lock for the mutual connection of the two angled limbs can be formed, because the two angled limbs must be pivoted or folded only in their working position, whereby the retaining element with its spreader element can lock on the end parts of the spring ring, which is already locked with one angled limb, in that the spreader element initially moves the two end parts apart against their restoring force until the undercutting located under the spreader element reaches the area of the end parts, so that these can then spring back into the position approaching each other and therefore fix the spreader element engaged by it from behind. Here, the dimensions are adjusted to each other so that this mutual fixing is achieved when the two angled limbs contact each other with their facing surfaces in the closed position.

For such a construction of the invention, it is sufficient to attach the spring ring in its working position to one angled limb in a locking manner, after which, for closing the plug-in connector, the two angled limbs only have to be folded together and locked with the end parts of the spring ring. This is considerably less time intensive than setting and tightening usually several screws and in addition, the risk that one of the parts used for the mutual locking will become damaged or will break off is considerably reduced. If the spring ring with its end parts becomes damaged or overloaded, it can be replaced very easily without the entire plug-in connector becoming unusable.

The end parts of the spring ring can extend approximately parallel to each other at least in some areas or can have sections or points lying on parallel lines and their spacing can be greater than the smallest dimension of the spreader element of the retaining element but smaller than its greatest dimension, which relates to the starting position of these end parts or also its location in the closed position. Thus, the spreader element can enter into the intermediate space of the two end parts when the two angled limbs are folded together and can then press the two end parts apart against their spring force due to its wedge shape or its conical form until the spreader element moves through the intermediate space between the two end parts and therefore the two angled limbs are also folded into their working position. Then the end parts spring back into the position approaching each other by themselves and thus fix the working position of the two angled limbs.

Here, the area of the retaining element located under the conical spreader element can have a dimension or width that corresponds approximately to the spacing of the two end parts of the spring ring or is slightly smaller or, if necessary, somewhat larger. If this dimension is less than or equal to the spacing of the two end parts of the spring ring, these can spring back practically into their starting position. In contrast, if the dimension or width of this area of the retaining element is somewhat larger than the spacing of the two end parts in their non-tensioned position, they also contact this area of the retaining element still with some spring force in the closed position.

The parallel profile of the end parts of the spring ring can be straight, wavy, or curved, especially curved in the opposite direction relative to each other. Therefore, such profiling can support the locking under some circumstances and can simultaneously reinforce the end parts against undesired permanent deformation.

A modified embodiment of the plug-in connector according to the invention provides that—before assembly—the recess or annular groove accommodating the stop spring or the spring ring after the free end of the associated angled limb is limited by a retaining element or flange part, which can be attached separately. It also provides that the stop spring or the spring ring can be placed before attaching the separate retaining element or flange part axially on the associated angled limb and then the still open recess or annular groove, and that after placing the stop spring or the spring ring, the part limiting the recess or annular groove can be attached to the angled limb. Thus, if the angled limb with the annular groove and the stop spring has a separate retaining element or flange part—possibly a rotating intermediate part, which allows rotation of the angled limb and thus the entire plug-in connector—this can be used to form a limit for the annular groove, so that the spring ring does not expand when inserted into the annular groove, but instead can be placed in the axial direction before the limit of the annular groove is attached at a later time.

The recess or annular groove can have in its profile an enlargement or widening as a recess, which can be dimensioned large enough that the spring ring located in the recess or annular groove can be gripped by means of a tool. Here, the widening of the recess can extend towards one or both sides of the recess or annular groove. Thus, the user can place a tool on the spring ring in the area of this widening and move the spring ring partially out of the annular groove, which leads to it expanding in the area of its gap or opening. In this way, the two end parts can be spread apart, so that they release the spreader or holding element engaging them and the plug-in connector can be opened.

Here, it is preferable when the widening of the annular groove of the opening is arranged opposite the gap in the spring ring approximately on a diameter or the cross-sectional center of the angled limb. If the spring ring is moved with a tool partially from its annular groove perpendicular to the center axis of the angled limb and therefore expands in the area of its opening or gap, this motion is distributed uniformly to both end parts.

The cross section of the part or wire forming the spring ring can be at least in some areas circular and/or polygonal, in particular, rectangular. Above all, a rectangular cross-sectional spring ring can fill a corresponding annular groove to a good degree and can form an essentially smooth profile on the outside of the angled limb. Here, it is favorable when the cross section of the part or wire forming the spring ring is constant over its entire profile.

In particular, the spring ring can fit into the recess or annular groove, thus it practically fills it completely, and is countersunk with its outer edge or its outer dimension with the edge of the recess or annular groove, or aligned with or opposite the groove edge. Therefore, it can be prevented that the spring ring projects past the contours of the angled limb and is possibly detached in an unauthorized or undesired way.

A preferred improvement for the stability of the entire angled plug-in connector can be provided in that the retaining element provided, in particular, with the spreader element, has a groove or similar recess, which is opened towards the angled limb, on which the spring ring is arranged, and that this angled limb with the spring ring has a locking projection fitting in the groove or recess. Therefore, the mutual connection of the two angled limbs is also stabilized in the transverse direction, so that forces exerted on the exposed angled limb in any direction can be easily introduced into the other angled limb and its attachment to a matching part or a housing wall.

An easy-to-handle arrangement provides that the two end parts of the spring ring are independent from each other and can be spread apart from each other easily accordingly. However, it can be useful that the end parts of the spring ring are connected to each other, especially integrally connected and, if necessary, the spring ring can be expanded together with the end parts against a restoring force elastically over the cross section of the angled limb accommodating it. Such a spring ring can then be expanded so far that it can be pushed axially over the not yet mounted angled limb until it has reached the annular groove, in which it can then be locked in the same way as an open angled limb also on the end parts. The interconnected end parts can then nevertheless project in approximately the radial direction opposite this angled limb and interact with a spreader element and a holding part on the other angled limb in the already described way. Also, such a spring ring also closed at the end parts can be spread and expanded by pulling it partially out of the annular groove in the area of the end parts so far that the spreader element of the retaining element is released in turn, in order to be able to pivot the angle limbs away from each other.

In all of the embodiments, it is favorable when the recess or annular groove is arranged in a plane running perpendicular to the center axis of the angled limb and when the end parts of this spring ring project from this angled limb at a right angle to the profile of this angled limb, especially eccentric to its center. Therefore they correspond well to a retaining element and its profile on another angled limb arranged at an angle or at a right angle to the angled limb with the spring ring.

The recess or annular groove can be provided on the angled limb arranged closer to a housing wall or a matching part, in particular, at an angle or at a right angle to this wall or matching part, and the retaining element for the end part or parts can be located on the angled limb that can pivot relative to or detach from this angled limb. The stop spring is then provided on the angled limb that can no longer move after being fixed to the housing wall or a matching part, so that in the working position the pivoting of the other angled limb has the effect that the retaining element located thereon is pressed between the end parts of the spring ring and thus can be locked.

However, it is also possible that the recess or annular groove is provided on the angled limb farther from a housing wall or a matching part, in particular, approximately parallel to this wall or matching part and that the retaining element for the end part or parts is located on the angled limb that can pivot relative to these end parts opposite the angled limb installed fixed to the housing wall or a matching part in the working position. For closing the plug-in connector, the angled limb is then pivoted together with the circular spring and its end parts, whereby these are then moved over the stationary retaining element and its spreader element, wherein expansion takes place that ends with the already described locking.

In all of the embodiments, it is useful when the retaining element is arranged on the angled limb carrying it in an area forming the inside of the angle in the working position and especially has a small width than that which corresponds to the greatest cross-sectional width or the diameter of the angled limb. The retaining element is therefore practically invisible from the outside and thus opening of such a plug-in connector is made more difficult, in particular, primarily for untrained or unauthorized persons.

Here, it is favorable if the retaining element and the end parts of the spring ring gripped or engaging with these end parts in the working position are arranged under the angled limbs, which exceed them in their width or cross-sectional dimension in the angled space of the angled plug-in connector and are shielded from the outside by the angled limbs. Therefore, the holding and the locking of the angled limb are protected and not accessible for unauthorized opening or even destruction without additional means.

The cross section of the angled limb can be circular or elliptical or square or rectangular, wherein these different cross-sectional shapes can also be provided differently on the two angled limbs. The profile of the spring ring is here adapted to the cross-sectional shape of the angled limb carrying it.

The angled limb connected to a housing wall or to a matching part can have a coaxial adapter having a rotary bearing for the angled limb and the plug-in connector and can be connected to this adapter and this adapter can limit the recess on one side, in particular, for a plug-in connector with an annular groove or recess arranged on the fixed angled limb for the spring ring. Thus, such an adapter can have a double function, in that on one hand it limits the annular groove for the spring ring or the circular spring and on the other hand allows the plug-in connector to rotate relative to a housing wall or a matching part about the center axis of the angled limb connected directly thereto.

It is still to be mentioned that a sealing ring or O-ring, which forms a sealing contact with the two facing contact surfaces of the angled limbs within the coupling area, can be arranged in the contact area of the two angled limbs. Here, the sealing ring or O-ring can be arranged in the working position in the radial direction deeper than the recess or annular groove, especially in an annular groove or the like adjacent to the recess or annular groove used for the mutual coupling or connection. Thus, despite the annular groove for the circular spring or the spring ring for mutual connection of the two angled limbs, at their contact area a seal can also be housed.

Primarily for the combination of individual or several of the previously described features and measures, an angled electric plug-in connector is produced, whose two angled limbs that can move or rotate relative to each other can be connected to each other by a quick-connect lock in their working position. Simultaneously, at least on one of the angled limbs, a latching element, which is connected integrally to this angled limb and which could become damaged or could break off, is eliminated and replaced by an easily exchangeable circular spring or a spring ring, on which projecting end parts can be used as latching elements.

So that the spring ring cannot be pulled too easily from the annular groove holding it perpendicular to the profile of the angled limb, it is useful if the annular groove and the spring ring run over approximately three-fourths or more, for example, over approximately four-fifths or approximately nine-tenths of the periphery of the associated angled limb. Through a wraparound angle of such a size the spring ring or the circular spring is reliably held in its working position, but nevertheless can be easily placed and locked perpendicular to the longitudinal center axis of the associated angled limb due to its spring-elastic property, if an axial placement is not possible—for example, on an annular groove that is initially open only halfway.

BRIEF DESCRIPTION OF THE DRAWINGS

Below, embodiments of the invention are described in more detail with reference to the drawings. Shown in partially schematized representation are:

FIG. 5 is a representation according to FIG. 4, wherein a tool or auxiliary tool grips the spring ring on its side facing away from the end parts and pulls the spring ring so far that the end parts are expanded by the widening of the spring ring and therefore are detached from the retaining element on the other angled limb, FIG. 6 is a graphical representation of a spring ring before its assembly, wherein the part forming the spring ring or bent into the spring ring or the wire forming the spring ring has a round or polygonal cross section, FIG. 7 is a representation according to FIG. 6, wherein the two end parts have an approximately arc-shaped construction and are connected to each other integrally over an arc, FIG. 8 is a representation of a modified, closed spring ring according to FIG. 7, which has a square or rectangular cross section.

DETAILED DESCRIPTION OF THE PREFERRED EMBODIMENTS

In the description of the different embodiments, parts with matching function are given matching reference numbers even if they have a modified construction.

An angled electric plug-in connector designated as a whole with 1 includes within a first angled limb 2 an insulating body, which has electric contacts and which is not shown in more detail and which is not visible, wherein the conductor or conductors projecting out of this insulating body and the electric contacts in a known way extend through a second angled limb 3 to a load and/or to a power source. The second angled limb 3 is fixed in the working position to a housing wall 4 or a comparable matching part, for example, to a pipe connection.

Figure 1:
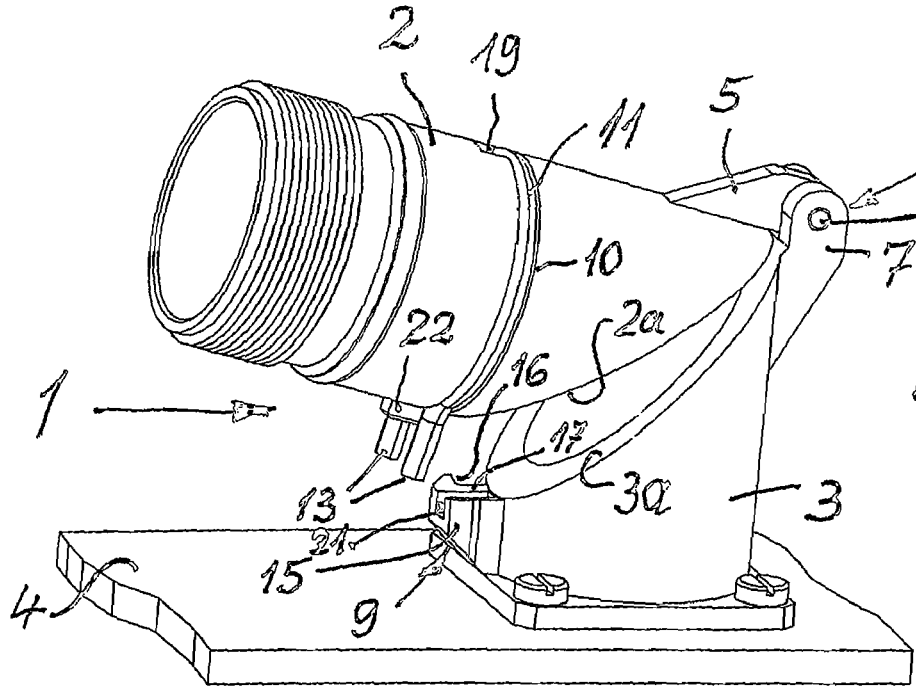
FIG. 1 is a graphical representation of a plug-in connector according to the invention with two angled limbs, which can pivot relative to each other, one of which is screwed onto a housing separating wall via a flange, and the other carries in an annular groove a spring ring, which is open in its profile and has on its opening two projecting end parts for fitting a retaining element arranged on the angled limb connected to the housing wall, but which is still separated from this retaining element, because this plug-in connector is not yet closed.
Figure 2:
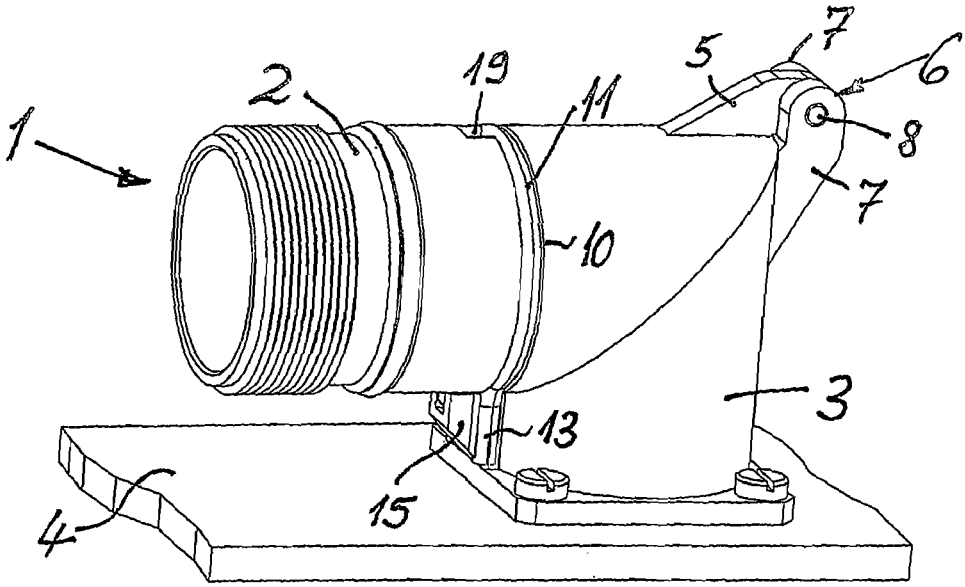
FIG. 2 is a representation according to FIG. 1 after the upper angled limb pivots into the working position, in which the two facing end faces forming a miter joint of these two angled limbs are in contact, wherein the end parts of the spring ring are latched to the retaining element.
Figure 3:
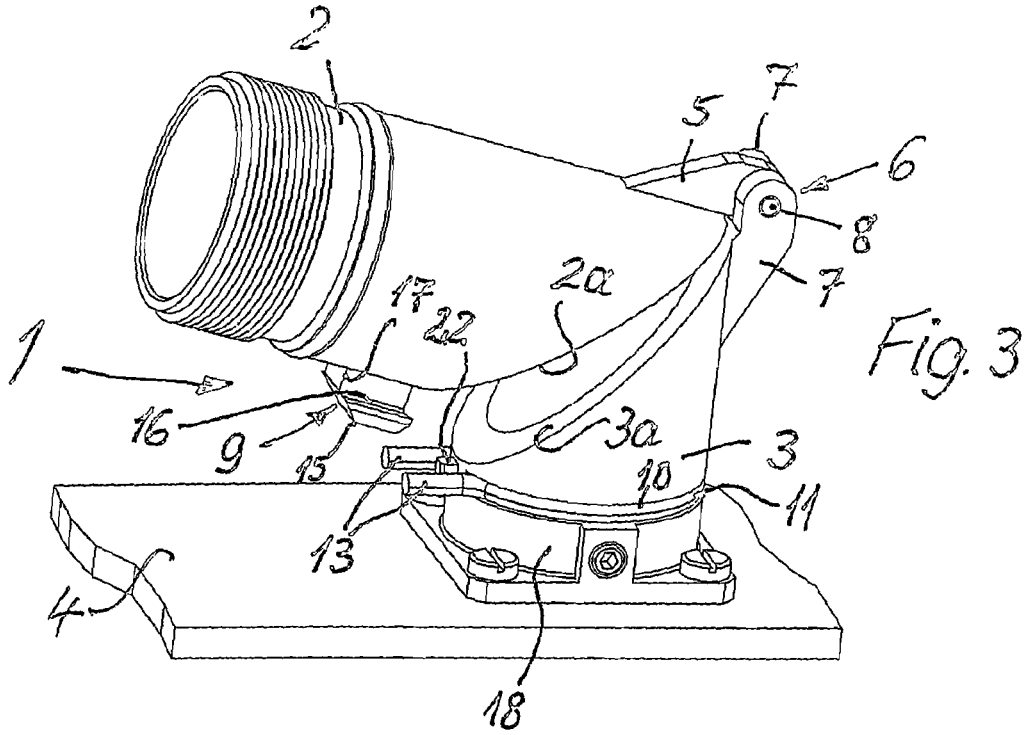
FIG. 3 is a representation according to FIG. 1, wherein the annular groove and the spring ring are arranged on the angled limb connected to the housing wall or the like and the retaining element is provided on the opposing, pivoting angled limb, wherein, in addition, the annular groove is limited on one side by an adapter, which contains a rotary bearing that allows rotation of the entire angled plug-in connector about a center axis of the angled limb connected to the housing wall, in the not-yet closed open position.
Figure 4:
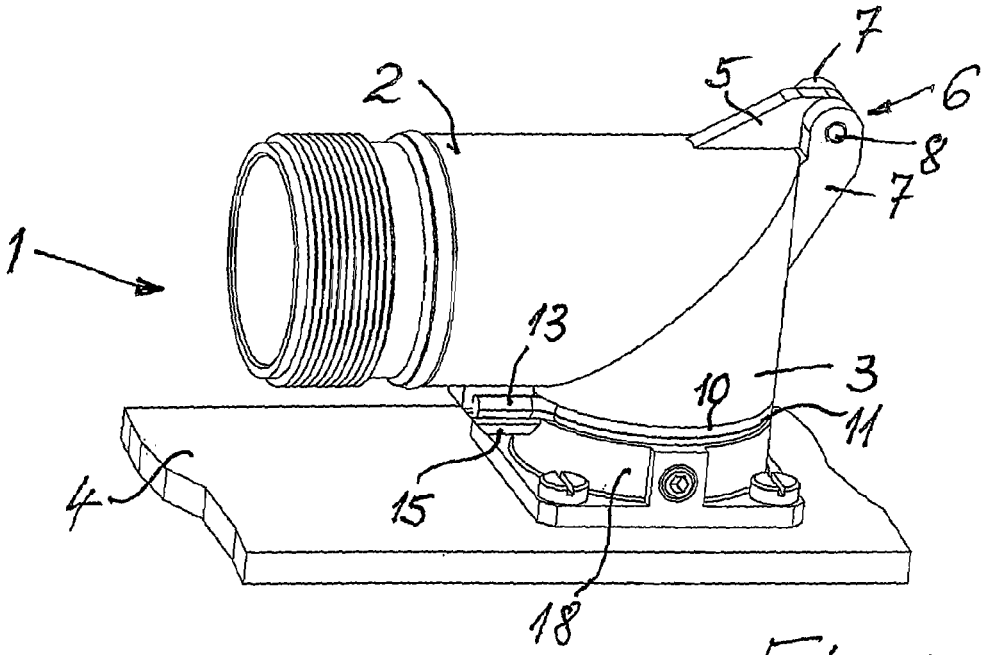
FIG. 4 is a representation according to FIG. 2 of the embodiment according to FIG. 3 after the free angled limb pivots into the working position, in which it is connected to the angled limb connected to the housing wall and is latched by the end parts of the spring ring.

The two end faces 2*a* and 3*a* of these angled limbs 2 and 3, which contact each other in an angled region in the functional position, are arranged at an angle and essentially form a miter joint, as can be seen especially clearly in FIGS. 1 and 3, but also in FIGS. 2, 4, and 5.

Approximately in the area of an outermost meridian line, the two angled limbs 2 and 3 are connected to each other in an articulated and possibly detachable way, wherein the first angled limb 2 in the embodiment has a radially projecting flat or flange part 5 as a part of a common joint 6, while on the second angled limb 3 there are two flange parts 7, which expose an intermediate space therebetween in which the first flange part 5 is engaged, wherein the flange parts 5 and 7 are connected to each other by a transverse pin 8 so that they can rotate or pivot.

However, any other joint form would also be conceivable. For example, the individual flange part 5 could also be provided on the second angled limb 3, while the flange parts 7 gripping this part on both sides in the working position could be arranged on the first angled limb 2.

In a way still to be described, a retaining element fixing the working position of the two angled limbs 2 and 3 and designated as a whole with 9 is also provided, wherein the working position is shown in FIGS. 2 and 4 and provides that the two end faces 2*a* and 3*a* are located in their closest mutual approach or contact each other.

In all of the embodiments, one can see that a recess or annular groove 10, which is open to the outside and which extends over the greater part of the periphery of this angled limb, practically over its entire profile, is provided on one of the two angled limbs, in the embodiment according to FIGS. 1 and 2 on the first angled limb 2 and, in the embodiment according to FIGS. 3 and 4 on the second angled limb 3. A fitted spring ring 11 can be inserted or locked in this recess or annular groove, wherein in FIGS. 6 to 8, different embodiments of such spring rings 11 are shown. In FIGS. 1 to 5, each spring ring 11 is already inserted or locked in the recess or annular groove 10.

The spring ring 11 is open or discontinuous in its profile in all of the embodiments, also in those according to FIGS. 7 and 8, in the sense that the annular form ends before completing a closed ring. One can clearly see in FIGS. 6 to 8 that the spring ring 11 has, in terms of its annular profile, an opening or gap 12, at which two end parts 13 extend from the profile of the spring ring 11 and project outwards, that is, past the contour of the spring ring 11.

The end parts 13 also project from the recess or annular groove 10 according to FIGS. 1 to 5 and extend from the corresponding angled limb 2 or 3, so that they can grip the retaining element 9 on the other angled limb 3 or 2 in the closed or working position of the plug-in connector 1 and are connected thereto or engaged therein in a way still to be described. Primarily, latching with the retaining element 9 is provided in a way to be described.

Here, all of the figures make it clear that the two end parts 13 of the spring ring 11 are arranged symmetric to each other and in the working position the retaining element 9 grips the other corresponding angled limb in common. For this purpose, the two end parts 13 of each spring ring 11 have, in the non-tensioned position according to FIGS. 6 to 8 and in the working position according to FIGS. 1 to 5, a smaller spacing than that corresponding to the greatest cross section of the corresponding angled limb 2 or 3 or to the diameter of the spring ring 11 and simultaneously these end parts 13 are bent outwards opposite the profile of the spring ring in the area of the opening 12 and are arranged in the plane spanned by the spring ring 11. The bends 14, through which the end parts 13 are connected to the actual spring ring 11, are here located practically at the opening 12 or limit this opening 12, as can be clearly seen in FIGS. 6 to 8.

Here, the end parts 13 have a spacing, in which a conical or wedge-shaped spreader element 15 of the retaining element 9 can be pressed while spreading at least these end parts 13 or their spacing. This spreader element is arranged on the other angled limb and there is an undercut 16 (FIGS. 1 and 3) behind the wedge-shaped or conical spreader element 15 for the end parts 13, wherein this spreader element 15 is shaped somewhat like a mushroom or has a somewhat mushroom-shaped longitudinal section and overlaps the spring ring end parts 13 in the working position with the spreader element 15 or the undercut 16 located on its bottom side.

When comparing FIGS. 1 and 2 or 3 and 4 it becomes clear that the retaining element 9 reaches into the area of the end parts 13 with its mushroom-shaped spreader element 15 upon closing the appropriate angled limb 2, so that these end parts 13 can be pressed apart from each other by the spreader element 15 until the undercut 16 reaches the area of the end parts 13. In this position (FIGS. 2 and 4) the end parts 13 can spring back into the non-tensioned or essentially non-tensioned position due to their spring force and then the spreader element 15 grips the undercut 16, that is, holds the angled limb 2 tight in the closed position.

In the embodiment, the end parts 13 of the spring ring 11 extend approximately parallel to each other in the non-tensioned position. They could also have sections or points lying only on parallel lines, however, wherein in all cases it is clear that their spacing is greater than the smallest dimension of the wedge-shaped spreader element 15 of the retaining element 9, but smaller than its greatest dimension. Thus, the spreader element 15 can initially enter between the end parts 13 with its smaller dimension and then can press apart or spread the end parts due to its increasing dimension when closing the angled limb until the undercut 16 is located in the area of the end parts 13. Here, according to FIG. 1 the spring ring with the end parts 13 can be moved relative to the stationary retaining element 9 and its spreader element 15 or according to FIGS. 3 and 4, conversely, the retaining element 9 with the spreader element 15 relative to the stationary end parts 13, in order to achieve the mutual, previously described latching.

The area 17 of the retaining element 9 located under the conical spreader element 15 in the area of the undercut has a dimension or width that corresponds approximately to the open or internal spacing of the two end parts 13 of the spring ring 11, so that these are practically in their original position in the working position according to FIG. 2 or 4. If necessary, however, this dimension or width of the area 17 could also be somewhat larger, so that the end parts 13 would contact this area with a spring tension.

According to FIGS. 7 and 8, the parallel profile of the end parts 13 of the spring ring 11 can also be curved, especially in the opposite sense, so that only one sub-area extends in parallel.

The recess or annular groove 10 holding the locking spring or the spring ring 11 is limited in the embodiment according to FIGS. 3 to 5 according to the free end of the associated angled limb 3, which end is connected in the working position to the housing wall 4, by a retaining element or flange part 18 that can be attached separately, so that the stop spring or the spring ring 11 can be placed axially on the associated angled limb and the recess or annular groove 10, which is still open on the side, before attaching this separate retaining element or flange part 18. After this axial placement of the stop spring or the spring ring 11, the part 18 defining the recess or annular groove 10 on the side can be attached to the angled limb 3, in order to close the annular groove 10 also on this side and to fix the spring ring 11 accordingly.

In an annular groove 10 limited in advance on both sides, in contrast, a spring ring according to FIG. 6 can be placed through spreading of its opening 12 approximately in the plane, in which the annular groove 10 is located, until it practically wraps around the annular groove 10 and then is latched into the working position.

In an analogous way, the spring ring according to FIG. 6, however, can also be removed again or at least pulled back so far that the end parts 13 are spread apart, because by pulling the spring ring 11 back, the groove base leads to a corresponding opposite-sense expansion of the stop spring or the spring ring 11, as indicated in FIG. 5. In this way, by spreading the end parts 13 it can be achieved that these end parts leave the undercut 16, so that the angled limb 2 can be opened again. An analogous situation applies to the arrangement according to FIGS. 1 and 2.

To allow and simplify this feature, the recess or annular groove 10 in its profile has an enlargement or widening 19 as a recess, which is dimensioned so large that the spring ring 11 located in the recess or annular groove 10 can be gripped by means of a tool 20, as indicated in FIG. 5. There a screwdriver is indicated, with which the spring ring 11 engages and can then be pulled back in the area of the widening 19, in order to cause the already mentioned spreading of the end parts 13.

The widening 19 of the recess can extend towards one side. However, it could also extend towards both sides of the recess or annular groove 10, in order to grip the spring ring 11, for example, with pliers.

It is further conceivable that the spring ring 11 itself has a retaining element or catch projection, on which a tool could attach, in order to be able to pull it back somewhat or completely from the working position.

The widening 19 of the annular groove 10 is arranged opposite the opening 12 or gap of the spring ring 11 approximately at a diameter or in the cross-sectional center of the angled limb 2 or 3 in the embodiment, so that the restoring forces applied with the help of the auxiliary tool 20 are distributed uniformly onto both end parts 13 and the end parts 13 are moved apart approximately uniformly.

In FIGS. 6 to 8 it is indicated that the cross section of the part or wire forming the spring ring 11 can be at least partially circular and/or, in particular, rectangular.

FIGS. 6 and 7 show spring rings 11 with circular cross section, while FIG. 8 shows an embodiment with a square or rectangular cross section of the material forming the spring ring 11.

Here, this cross section of the part or wire forming the spring ring 11 is constant over its entire profile. Here, the spring ring 11 fits into the recess or annular groove 10 and is aligned with its outer edge or its outer dimension with the edge or annular groove or countersunk relative to the groove edge, so that there is no overhang by the spring ring 11 on the corresponding angled limb 2 or 3. The annular groove 10 can be filled to an especially good degree if a spring ring is used with a rectangular cross section of the wire or part forming it and the cross-sectional shape of the spring ring is adapted to that of the annular groove 10.

According to FIG. 1, the retaining element 9 has a groove 21 or a similar recess, which is open towards the angled limb, on which the spring ring 11 is arranged in each embodiment. Accordingly, in the embodiment according to FIG. 3, a corresponding groove is also provided on the retaining element 9, which, however, cannot be seen from the viewing angle shown in FIG. 3. The other angled limb with the spring ring 11 has a locking projection 22 fitting in this groove or recess 21, so that in the closed position of the two angled limbs, transverse forces can also be transferred well. This locking projection 22 can be seen both in FIG. 1 and also in FIG. 3.

In FIGS. 7 and 8, a special feature is shown to the extent that the end parts 13 of the spring ring 11 are connected to each other, that is, integrally, so that the resulting structure has a closed profile as a whole despite the opening 12. Here, this spring ring 11 can expand elastically beyond the cross section of the angled limb holding it together with the end parts 13 against the restoring force, that is, it can widen accordingly in the axial direction of the angled limb until the spring ring 11 engages in the annular groove 10 and latches and the interconnected end parts 13 extend in the already described way. These interconnected end parts 13 can then interact in the already described way with a spreader element 15 of the retaining element 9, are moved apart by this spreader element 15, and reach elastically into the undercut 16 behind the corresponding spreader element 15, wherein the spreader element 15 and the undercut 16 preferably have contours adapted to the profile and the connection of the connected end parts 13. For example, in this case the spreader element 15 can have round contours in contrast to the rectangular shape of the shown embodiments.

Preferably, the recess or annular groove 10 is arranged in all of the embodiments in a plane at a right angle to the corresponding center axis of the angled limb with it and the end parts 13 of this spring ring 11 project from it at a right angle to the profile of this angled limb eccentric to its center, as can be seen well in FIGS. 1 and 3. This leads to a favorable form and arrangement of the annular groove 10 and also the spring ring 11 relative to an arrangement, in which the annular groove 10 and the plane spanned by it would be arranged at an angle to the center axis.

In the embodiment according to FIGS. 3 to 5, the recess or annular groove 10 is provided in the angled limb 3, which is closer to a housing wall 4 or a matching part and which is arranged, in particular at an angle or—as in the embodiment—at a right angle to this wall or matching part and the retaining element 9 for the end part 13 or parts is located on the angled limb 2 that can pivot relative to or detach from this angled limb 3.

In the embodiment according to FIGS. 1 and 2, the recess or annular groove 10 is provided on the angled limb 2 farther away from the housing wall 4 or a matching part, in particular approximately parallel to this wall or matching part in the working position, and the retaining element 9 for the end part or parts 13 is located on the angled limb 2 that can pivot relative to this wall or matching part opposite the angled limb 3 installed rigidly on the housing wall 4 or matching part in the working position.

In both cases, when the angled limb 2 pivots from the open position into the closed position shown in FIGS. 2 and 4, the already mentioned latching of the retaining element 9 with the end parts 13 is realized, wherein in the case according to FIGS. 3 to 5 the retaining element 9 is moved between the stationary end parts 13 and in the case of the embodiment according to FIGS. 1 and 2, the end parts 13 are moved relative to the stationary retaining element 9. In both cases, the spacing or intermediate space between the end parts 13 expands until it exceeds the spreader element 15 and can engage in the undercuts 16 located behind this part.

In both embodiments it is provided that the retaining element 9 is arranged on the angled limb carrying it in an area forming the inside of the angle in the working position and here has a smaller width than that corresponding to the largest cross-sectional width or the diameter of the corresponding angled limb 2 or 3. Accordingly, the retaining element 9 and the gripped or engaging end parts 13 of the spring ring 11 are arranged in the working position underneath the angled limbs 2 or 3, which exceed them in their width or cross-sectional dimension in the angled space of the angled plug-in connector and are shielded from the outside by the angled limbs 2 and 3, so that the closure including the end parts 13 and the retaining element 9 is protected and essentially inaccessible for unauthorized persons.

In the embodiments, the cross section of the angled limbs 2 and 3 is circular. However, it could also be elliptical or square or rectangular, wherein one angled limb could have, for example, a circular cross section and the other limb could have a rectangular or square cross section. In all of the cases, the profile of the spring ring 11 is adapted to the cross-sectional shape of the angled limb, wherein the spring ring 11 must wrap around and enclose the corresponding angled limb so far that the described latching and positive-fit holding is achieved.

In the embodiment according to FIGS. 3 to 5, the angled limb 3 connected to a housing wall 4 or a matching part in the working position has a coaxial adapter, which contains a rotary bearing for the angled limb and the plug-in container 1 and which was already mentioned as a retaining element and flange part 18. By means of the connection to this adapter 18, the entire plug-in connector 1 can rotate relative to the housing wall 4, that is, the direction of the angled limb can be changed. As already mentioned, here this adapter or flange part 18, in the case that the recess or annular groove 10 is arranged on this fixed angled limb 3, can limit this recess for the spring ring to one side. However, it would also be conceivable to provide such an adapter 18 for an embodiment according to FIGS. 1 and 2, in which the spring ring 11 is arranged in an annular groove 10 on the angled limb 2.

In a way that is not described in more detail, in the contact area of the two angled limbs 2 and 3 there is a sealing ring or O-ring, which can form a sealing contact on the two facing contact surfaces 2*a* and 3*a* within the coupling area. Here, this sealing ring or O-ring can be arranged in an annular groove or the like in the working position in the radial direction deeper than the recess or annular groove 10.

It is also to be mentioned that the annular groove 10 and the spring ring 11 arranged in it in the working position run over approximately three-fourths or more, for example, over approximately four-fifths or approximately nine-tenths of the periphery of the associated angled limb 2 or 3, wherein the annular groove can even run over the entire periphery for the sake of simplicity. A correspondingly large wraparound with a corresponding large latching force of the spring ring 11 is produced in this way.

The angled electric plug-in connector 1 with two angled limbs 2 and 3 that can move relative to each other and that can pivot or fold can be held in its closed or working position in that on one of the two angled limbs there is a recess or annular groove 10, which runs over the greater part of its periphery and which is open to the outside and in which a fitting spring ring 11 is arranged, wherein this spring ring 11 is open or discontinuous in its profile and has at the opening 12 or gap two end parts 13, which project outwards opposite the ring profile and thus extend away from the angled limb and can engage a retaining element 9 on the other angled limb in a preferably latching manner in the closed position of the two angled limbs.

The angled plug-in connector 1 has an insulating body that contains electric contacts and that is arranged in a first angled limb 2, wherein the conductor or conductors projecting out of the insulating body and the electric contacts run through a second angled limb 3. The two end faces 2*a*, 3*a* of these angled limbs 2, 3 contacting each other in the angled region are arranged at an angle and essentially form a miter joint and are interconnected in a hinged or detachable way. On at least one of the two angled limbs there is a recess or annular groove 10, which extends over the greater part of its periphery and which is open outwards at least over a portion of its profile and in which a spring ring 11, which fits in this recess or groove, can be inserted or engaged, which is open or discontinuous in its profile and has at the opening or gap 12 two end parts 13, of which at least one extends out from the recess or annular groove 10 in the working position and projects from the angled limb and grips a retaining element 9 on the other angled limb in the closed or working position of the plug-in connector 1.

The invention claimed is:

1. Angled electric plug-in connector (1), comprising an insulating body which has electric contacts that are arranged in a working position in a first angled limb (2) of the plug-in connector, a conductor or conductors projecting from the insulating body and the electric contacts extend through a second angled limb (3) to a load or to a power source, wherein two end faces (2*a*, 3*a*) of the angled limbs (2, 3) that contact each other in an angled region are arranged at an angle and generally form a miter joint and are interconnected at least in the working position in a hinged or detachable manner, and a retaining element (9) fixing the working position of the two angled limbs (2, 3), a recess or annular groove (10) is located on at least one of the two angled limbs and extends over a greater part of a periphery thereof and is open to an outside at least over a portion of a profile thereof in which a spring ring (11) that fits in the recess or groove can be inserted or engaged; the spring ring (11) is open or discontinuous in profile and has at an opening or gap (12) two end parts (13), of which at least one projects out from the recess or annular groove (10) in the working position and extends from the angled limb and grips, connects to, or engages the retaining element (9) on other angled limb in a closed position of the plug-in connector (1).

2. Plug-in connector according to claim 1, wherein the two end parts (13) of the spring ring (11) grip or engage or are connected to the retaining element (9) on the other angled limb in the working position.

3. Plug-in connector according to claim 1, wherein in the working position, the two end parts (13) of the spring ring (11) have a smaller spacing than that corresponding to a greatest cross section of the angled limb (2, 3) or to a diameter of the spring ring (11) and the end parts (13) are bent outwards opposite the spring ring profile and arranged in a plane spanned by the spring ring (11).

4. Plug-in connector according to claim 1, wherein the end parts (13) of the spring ring (11) that project from the annular groove (10) of one angled limb and opposite the spring ring (11) in a direction towards the other angled limb have a spacing, in which a conical spreader element (15) of the retaining element (9) can be pressed in while widening at least the end parts (13) or a spacing therebetween, the spreader element is arranged on the other angled limb and there is an undercut (16) under the conical spreader element (15) for the end parts (13), the conical spreader element (15) is generally mushroom shaped or has a somewhat mushroom-shaped longitudinal section and grips over the spring ring end parts (13) in the working position with the spreader element (15).

5. Plug-in connector according to claim 4, wherein the end parts (13) of the spring ring (11) extend at least in some areas approximately parallel to one another or have sections or points lying on parallel lines and their spacing is greater than a smallest dimension of the spreader element (15) of the retaining element (9) but smaller than a greatest dimension thereof.

6. Plug-in connector according to claim 4, wherein an area (17) of the retaining element located under the conical spreader element (15) has a dimension or width that corresponds approximately to a spacing of the two end parts (13) of the spring ring (11) or is slightly smaller or possibly somewhat larger.

7. Plug-in connector according to claim 1, wherein the end parts (13) of the spring ring (11) are straight, wavy, or curved, in opposite directions relative to each other, in a parallel profile thereof.

8. Plug-in connector according to claim 1, wherein the recess or annular groove (10) holding the spring ring (11) is limited towards a free end of the associated angled limb (3) by a retaining element or flange part (18) that can be attached separately and or the spring ring (11) can be placed axially on the associated angled limb and the still open recess or annular groove (10) before attaching the separate retaining element or flange part (18) and after placing the spring ring (11), the part (18) limiting the recess or annular groove (10) can be attached to the angled limb (3).

9. Plug-in connector according to claim 1, wherein the recess or annular groove (10) has in a profile thereof an enlargement or widening (19) that defines a recess, which is dimensioned to be large enough so that the spring ring (11) located in the recess or annular groove (10) can be gripped by a tool (20).

10. Plug-in connector according to claim 9, wherein the widening (19) of the recess (10) extends towards one or towards both sides of the recess or annular groove (10).

11. Plug-in connector according to claim 9, wherein the widening (19) of the annular groove (10) is arranged opposite the opening (12) or gap of the spring ring (11) approximately on a diameter or a cross-sectional center of the angled limb (2, 3).

12. Plug-in connector according to claim 1, wherein a cross section of a part or wire forming the spring ring (11) is circular and/or polygonal at least in some areas.

13. Plug-in connector according to claim 12, wherein the cross section of the part or wire forming the spring ring (11) is constant over an entire profile thereof.

14. Plug-in connector according to claim 1, wherein the retaining element (9) has a groove (21) or a similar recess, which is open towards the angled limb, on which the spring ring (11) is arranged, and the angled limb with the spring ring (11) has a locking projection (22) that fits in the groove or recess (21).

15. Plug-in connector according to claim 1, wherein the end parts (13) of the spring ring (11) are integrally connected to each other and the spring ring (11) can be expanded together with the end parts (13) against a restoring force elastically over a cross section of the angled limb holding it.

16. Plug-in connector according to claim 1, wherein the recess or annular groove (10) is arranged in a plane extending at a right angle to a center axis of the angled limb and the end parts (13) of the spring ring (11) project from the limb at a right angle to a profile of the angled limb.

17. Plug-in connector according to claim 1, wherein the recess or annular groove (10) is provided on the angled limb (3) closer to one housing wall (4) or a matching part and arranged at an angle or at a right angle to the wall or matching part and the retaining element (9) for the end part or parts (13) is located on the angled limb (2) that can pivot relative to or that can be detached from the angled limb (3).

18. Plug-in connector according to claim 1, wherein the recess or annular groove (10) is provided on the angled limb (2) farther away from a housing wall (4) or a matching part and arranged, in particular, approximately parallel to the wall or matching part and the retaining element (9) for the end part or parts (13) is located on the angled limb (3) installed opposite the pivoting angled limb (2) in the working position fixed on the housing wall (4) or a matching part.

19. Plug-in connector according to claim 1, wherein the retaining element (9) is arranged on the angled limb in an area forming an inside of the angle in the working position and has a smaller width than that corresponding to a greatest cross-sectional width or diameter of the angled limb (2, 3).

20. Plug-in connector according to claim 1, wherein the retaining element (9) and the end parts (13) of the spring ring (11) gripped or engaged with the retaining element in the working position are arranged underneath the angled limbs (2, 3), which exceeds them in a width or cross-sectional dimension, in an angled space of the angled plug-in connector (1) in the working position, and are shielded from outside by the angled limbs (2, 3).

21. Plug-in connector according to claim 1, wherein a cross sectional shape of the angled limbs (2, 3) is circular or elliptical or square or rectangular and a profile of the spring ring (11) is adapted to the cross-sectional shape of the angled limb.

22. Plug-in connector according to claim 1, wherein the angled limb (3) connected to a housing wall (4) or a matching part has a coaxial adapter (18) containing a rotary bearing for the angled limb and the plug-in connector (1) and is connected to an adapter and the adapter (18) for the plug-in connector with an annular groove (10) or recess for the spring ring (11) of the adapter arranged on the fixed angled limb (3) limits the recess (10) towards one side.

23. Plug-in connector according to claim 1, wherein the spring ring (11) fits in the recess or annular groove (10) and is aligned with an outer edge or outer dimension thereof with an edge of the recess or annular groove (10) or is countersunk relative to the groove edge.

24. Plug-in connector according to claim 1, wherein in a contact area of the two angled limbs (2, 3) there is a sealing ring or O-ring, which forms a sealing contact on two facing contact surfaces of the angled limbs within the coupling area.

25. Plug-in connector according to claim 24, wherein the sealing ring or O-ring is arranged in an annular groove in the working position in a radial direction deeper than the recess or annular groove (10).

26. Plug-in connector according to claim 1, wherein the annular groove (10) and the spring ring (11) extend over at least approximately three-fourths of a periphery of the associated angled limb.

* * * * *